United States Patent [19]

Jones

[11] 4,204,685

[45] May 27, 1980

[54] THREE DIMENSIONAL ALIGNMENT GAME

[76] Inventor: Clyde K. Jones, 211 Glenwood Ct., San Antonio, Tex. 78210

[21] Appl. No.: 969,321

[22] Filed: Dec. 14, 1978

[51] Int. Cl.[2] ..... A63F 3/00

[52] U.S. Cl. ..... 273/241; 273/271

[58] Field of Search ..... 273/241, 271

[56] References Cited

U.S. PATENT DOCUMENTS

| | | | |
|---|---|---|---|
| 2,801,107 | 7/1957 | Greer | 273/241 |
| 3,046,016 | 7/1962 | Laws | 273/241 |
| 3,604,705 | 9/1971 | Hawthorne | 273/241 X |
| 3,606,333 | 9/1971 | Green | 273/241 X |

*Primary Examiner*—Anton O. Oechsle

[57] ABSTRACT

A three dimensional alignment game comprising an upstanding gameboard structure and pieces for selective placement therein. The upstanding structure is comprised of five horizontally disposed levels or tables in vertical alignment with each other. Each table is formed of aluminum wire to provide a circular array of eight openings. Each opening of a given table is vertically aligned with corresponding openings of the tables above and/or below the given table. The pieces are in the form of pegs sized to be received in and supported by the openings. Each player receives a plurality of color distinguished pegs and the players take turns placing the pegs in the openings in an effort to be the first to achieve a grouping of five pegs either (1) in vertical alignment, (2) adjacent to each other on a single table, or (3) in one step offset relation from table to next adjacent table.

1 Claim, 3 Drawing Figures

THREE DIMENSIONAL ALIGNMENT GAME

SUMMARY OF THE INVENTION

This invention resides in a three dimensional game of alignment wherein numerous possibilities are provided for aligning five pieces in arrangements to be hereinafter described.

The principal object of this invention is to provide a game of the character described which combines simplicity and durability together with inexpensiveness of construction.

Another object of this invention is to provide a game of the character described which is challenging and entertaining and develops the art of concentration of those playing the game.

Other objects of this invention may be readily discerned by reading the following description and claim.

BRIEF DESCRIPTION OF THE DRAWING

In the accompanying drawing, in which like reference characters identify the same or like parts.

DESCRIPTION OF THE PREFERRED EMBODIMENT

Figure 1:
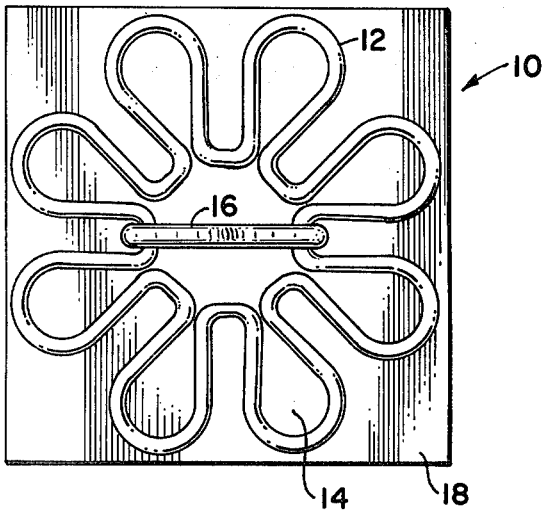
FIG. 1 is a top plan view of the upstanding gameboard structure of the invention.
Figure 2:
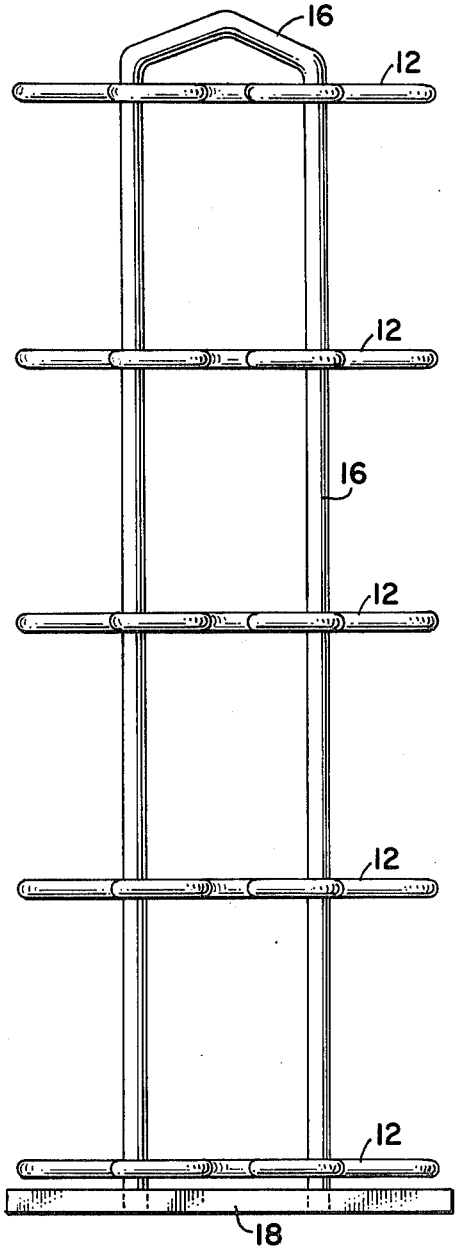
FIG. 2 is an elevational side view of the same.

With reference to the drawing, there is shown and illustrated a game apparatus constructed in accordance with the principles of the invention and designated generally by the reference character 10. The gameboard proper is comprised of an open framework of five horizontally disposed, veticallly aligned tables 12 which constitute support surfaces for playing pieces to be later described. Each table 12 is comprised of a wire configured to form a circular array of eight openings 14. Each opening 14 is in vertical alignement with a corresponding opening 14 in the table directly above and/or below. Tables 12 are supported by an inverted generally U-shaped wire member 16 the legs of which engage each table 12 at opposed points thereof to maintain the tables as shown in FIGS. 1 and 2. Member 16 is notched (not shown) at its points of engagement with the tables to enhance the interengagement of member 16 and tables 12. The ends of the legs of member 16 are received in a horizontally disposed base board 18 of preferably square configuration.

Figure 3:
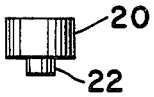
FIG. 3 is a side view of a player's piece of the invention.

The playing pieces (FIG. 3) are in the form of pegs each having an enlarged circular cross section portion 20 and a reduced circular cross section portion 22. The reduced portion 22 is sized to be received in any of openings 14 and enlarged portion 20 is sized to be suppprted by those portions of the wire which form openings 14 in tables 12. Preferably eighteen red pegs and eighteen white pegs are provided.

Although the above elements of the invention can be constructed of a large number of materials in a wide variety of ways, an acceptable construction is one which employs ⅛ inch diameter aluminum wire to form tables 12, 3/32" aluminum wire to form table support 16, 3"×3", 3/32" thick pressed wood to form the base, and ½" dowels to form the pieces. The above construction affords relatively unimpeded visibility of all playing positions of the gameboard from all positions above and around it.

Either two or four players can play the game. When two play, each player receives eighteen pegs of a single color. The players then take turns placing a single peg in any unoccupied opening of their choosing. Once a play is made it may not be changed without permission of the other player. When four persons play as partners, each player receives nine pegs of a single color with partners being provided with pegs of the same color. The players play in rotation by placing a single peg in any unoccupied opening 14. Players are not allowed to indicate in any way what play his partner should make.

The object of the game is to place five pegs of a single color in a defined alignment constituting a "row". A "row" consists of (1) five pegs in vertical alignment, (2) five pegs adjacent each other on a single table, or (3) five pegs each on a different table which each peg at each succeeding level being offset by one opening location with the succession of located pegs being offset in the same circular direction in progressing from the uppermost table to the lowermost table, or vice-versa. The latter type of alignment is termed a "parabola form".

It can be seen that forty openings are provided for the placement of pegs thus, there are forty ways to align pegs circularly, eight ways vertically, and sixteen ways in the parabola form.

I claim:

1. An alignment game apparatus comprising an open framework structure including five vertically aligned, horizontally disposed playing surfaces, each surface comprising a wire configured to form a circular array of eight openings, each opening in each surface being of equal size and in vertical alignment with a corresponding opening in the surface immediately thereabove and/or therebelow, and a plurality of pegs in each of two differently colored sets, each peg being sized to be received in and supported by any of said openings, said pegs being alternately placed in said openings by opposing players in an effort to place five pegs of a single said surface, in vertical alignment, or in one step offset relation from surface to adjacent surface employing all five surfaces.

* * * * *